US006727215B2

(12) United States Patent
Roberts et al.

(10) Patent No.: US 6,727,215 B2
(45) Date of Patent: Apr. 27, 2004

(54) ARTICLES CONTAINING ENCLOSED COMPOSITIONS

(75) Inventors: Nigel Patrick Somerville Roberts, Ponteland (GB); Derek Dasong Liu, Beijing (CN); James Song, Beijing (CN); Xiao Liang Tan, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 231 days.

(21) Appl. No.: 09/911,768

(22) Filed: Jul. 24, 2001

(65) Prior Publication Data

US 2002/0077264 A1 Jun. 20, 2002

(51) Int. Cl.[7] ..... C11D 17/04

(52) U.S. Cl. ..... 510/296; 510/120; 510/220; 510/406; 510/439; 424/400

(58) Field of Search ..... 510/296, 439, 510/120, 220, 406; 424/400

(56) References Cited

U.S. PATENT DOCUMENTS

| | | | | | |
|---|---|---|---|---|---|
| 4,082,678 | A | | 4/1978 | Pracht et al. | 8/137 |
| 4,776,455 | A | | 10/1988 | Anderson et al. | 206/0.5 |
| 4,846,992 | A | * | 7/1989 | Fonsny | 510/296 |
| 4,973,416 | A | | 11/1990 | Kennedy | 510/296 |
| 5,132,036 | A | * | 7/1992 | Falou et al. | 510/277 |
| 6,037,319 | A | * | 3/2000 | Dickler et al. | 510/439 |
| 6,281,183 | B1 | * | 8/2001 | Harbour | 510/406 |

FOREIGN PATENT DOCUMENTS

| | | | |
|---|---|---|---|
| EP | 0132726 | * | 2/1985 |
| EP | 0 414 462 A2 | | 2/1991 |
| GB | 2 187 748 A | | 9/1987 |
| GB | 2 254 857 A | | 10/1992 |

* cited by examiner

*Primary Examiner*—Lorna M. Douyon
(74) *Attorney, Agent, or Firm*—Marianne Dressman; Armina E. Matth ws; Kim William Zerby

(57) ABSTRACT

The present invention relates to an article comprising a first pouch made of a water-reactive material, which comprises a) a first solid or liquid composition; and b) a second pouch made of a water-reactive material, comprising in its interior a second solid or liquid composition. Also provided are processes for making such article. Alternatively, the second pouch is preferably joined to the first pouch side-by-side. Preferred articles comprise fabric cleaning compositions for laundry, dish washing or hard surface cleaning or fabric care compositions.

16 Claims, No Drawings

ARTICLES CONTAINING ENCLOSED COMPOSITIONS

CROSS REFERENCE TO RELATED APPLICATIONS

This application claims priority under 35 U.S.C. § 119(a) to Great Britain Application No. 0018055.4, filed Jul. 24, 2000.

FIELD OF THE INVENTION

This invention relates to an article comprising a first pouch made from a water-soluble film. The present invention also relates to an article for providing sequential release of at least two different compositions.

BACKGROUND OF THE INVENTION

Cleaning products and fabric care products can be found on the market in various forms, such as granular compositions, liquid compositions and tablets. It is also known to put cleaning products in unit dose sachets, which can be water-soluble or water-permeable, to release the product when added to water. Such sachets, for example laundry sachets, may have two compartments, which each comprise different ingredients, typically ingredients which are not compatible with one another. These compartments are typically attached to another.

We have found an improved way of delivering a sachet comprising two compartments or more with for example different compositions per compartment. This new sachet or article of the invention comprises a first pouch made from a water-reactive (soluble) film, which comprising in its interior a first composition and an another pouch made also made from a water-reactive (soluble) film, containing a second composition. The second pouch is completely enclosed by the first pouch.

The article of the invention combines all advantages of single compartment pouches with the advantages of dual (or more) compartment pouches. The advantages of the article of the invention and the way of making it, include for example: the second pouch is not in contact with the external environment (air) and is thus better protected; the first pouch and first composition dissolve before the second pouch and second composition, which provides an easy way to deliver ingredients sequentially to the (wash) water; the article has reduced seals on the outside surface, so reduced chance of leakage through the seals; ease of making these new articles; reduced process complexity (compared to attaching compartments to one another); and it is even possible to reduce the amount of pouch material needed. Also, the second pouch and also the articles as a whole are much more impact robust, as compared to pouches with separate compartments attached to another (for example, the compressive force required to expel liquid from the second pouch in such an article is much higher, e.g. 50% or more, depending on the execution).

Also, in the case of a second pouch containing a liquid which is contained within a first powder-containing pouch, the powder can easily absorb any small amount of liquid leaking from the second pouch, and/or the resulting article is much less susceptible to minor leaking from second pouch. In the case of a liquid-containing pouch within a liquid containing pouch, only the first pouch is susceptible to leaking to the external environment.

SUMMARY OF THE INVENTION

The invention relates to an article comprising a first pouch made of a water-reactive material which comprises in its interior a) a first solid or liquid composition; and b) a second pouch made of a water-reactive material comprising in its interior a second solid or liquid composition.

In a further embodiment of the present invention, a first pouch contains therein a first composition and a second pouch contains therein a second composition. The first pouch is made of a material which releases the first composition significantly earlier than the second pouch releases the second composition. Preferably, the first composition is a builder composition, while the second composition is a fabric care composition, fabric cleaning composition, or hard surface cleaning composition. Such an embodiment preferably employs a first pouch which quickly dissolves and/or ruptures to release the first composition, and a second pouch which dissolves and/or ruptures more slowly to release the second composition. This arrangement provides especially useful benefits, such as allowing sequential water softening and subsequent cleaning. Furthermore, as the first pouch dissolves and/or ruptures before the second pouch, in this embodiment the first pouch need not contain therein the second pouch; and yet this embodiment also provides for sequential release of the contents of the first composition and then the second composition.

The invention also relates to a process for making such an article; this process preferably comprises the step of making the first and/or second pouch by vacuum-forming or thermoforming.

DETAILED DESCRIPTION OF THE INVENTION

Article and Pouches

The article of the invention, comprises at least two pouches, and in a preferred embodiment, at least one pouch completely encloses at least one other pouch. The pouches herein are a closed structure, each having an interior (a volume space) comprising therein a liquid or solid composition. These pouches can be of any form, shape and material which is suitable to hold the composition, e.g. without allowing the release of the composition from the pouch prior to contacting the pouch with water. The first and/or second pouch may comprise, in addition to the second pouch, additional (third and further) pouches containing a third and further composition. The exact execution of the article will depend on, for example, the type and amount of the composition in each pouch, the number of pouches, the characteristics required from the article or pouches to hold, protect and deliver or release the compositions.

Each pouch comprises a liquid or solid composition, which may be any composition, to be delivered to form a solution (typically in water) and which can benefit from this article arrangement or delivery form, but preferred are fabric care, or cleaning compositions, as described herein after. Typical are either compositions having actives to be delivered to water at different moments (sequential release) and/or actives to be separate from one another for any reason, such as chemical or physical stability of these actives or the composition as a whole.

The article may be of such a size that it conveniently contains either a unit dose amount of the composition herein, suitable for the required operation, for example one wash, or only a partial dose, to allow the consumer greater flexibility to vary the amount used, for example depending on the size and/or degree of soiling of the wash load. The second pouch contained in the first pouch is of course smaller than this first pouch. Exact sizes will depend on how much each pouch need to contain and thus how much volume is required. Because the invention is useful for delivering a specific active at a later stage or protecting a specific active form the external environments (air) or from other actives in the other pouch, the second pouch typically has a relative small volume, for example less than 50% or even less than 30% or even less than 20% of the volume of the first pouch, and typically more than 3%, preferably more than 5%. Of course, this equally applies for any further pouches contained in the first pouch, and the same volume ratio applies preferably for further pouches contained in the second pouch. When the article is for use in a washing or dish washing machine and may need to be dispensed to the water via a dispensing drawer, it is useful that the second pouch is of such a size that it can dispense into the wash water through the small holes in the drawer, in particular when the article is for sequential release of product and is made such that the first pouch dissolves in the dispensing drawer and the second pouch does not dissolve in the drawer, but is dispensed completely in to the wash water.

The pouches are made from a water-reactive material. For the purpose of the invention, water-reactive material means material which either dissolves, ruptures, disperses or disintegrates (or mixtures thereof) upon contact with water, releasing thereby the composition. Preferably, the material is water-soluble.

The first pouch will react in water to release its contents before the second pouch, due to the nature of the construction of the article. To further enhance this sequential release, the first pouch may be more water-soluble than the second pouch. This can for example be achieved by using different type of material for the first pouch than for the second pouch, for example, the first pouch is made of a material having a different type of polymer, different plasticiser, different levels components in the material, different coating of the film material, different thickness of the film material. In a preferred embodiment of the invention, the pouches are made by a process involving stretching the material used for the pouch. Then, the above effect can also be achieved by stretching the material to a greater degree in the first pouch as compared to the second.

The first pouch is preferably made from a water-soluble film, said water-soluble film having a solubility in water of at least 50%, preferably at least 75% or even at least 95%, as measured by the method set out hereinafter using a glass-filter with a maximum pore size of 50 microns, namely:

Gravimetric method for determining water-solubility of the material of the compartment and/or pouch:

50 grams±0.1 gram of material is added in a 400 ml beaker, whereof the weight has been determined, and 245 ml±1 ml of distilled water is added. This is stirred vigorously on magnetic stirrer set at 600 rpm, for 30 minutes. Then, the mixture is filtered through a folded qualitative sintered-glass filter with the pore sizes as defined above (max. 50 micron). The water is dried off from the collected filtrate by any conventional method, and the weight of the remaining polymer is determined (which is the dissolved or dispersed fraction). Then, the % solubility or dispersability can be calculated.

It may be preferred that the second pouch is made of a material having equal water-solubility as the first pouch material; it may also be preferred, as set out above, that the solubility of the second pouch is less than the first pouch, and that the film of the second pouch has a solubility which is only 90% or less, or even only 80% or less, or even only 60% or less or even only 50% or less of the solubility of the first material measured as defined above. Such a differential in solubility is especially preferred where the first pouch does not contain therein the second pouch.

Preferred materials are films of polymeric materials, e.g. polymers which are formed into a film or sheet. The film can for example be obtained by casting, blow-moulding, extrusion or blow extrusion of the polymer material, as known in the art. Preferred polymers, copolymers or derivatives thereof are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferably the polymer is selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, most preferably polyvinyl alcohols, polyvinyl alcohol copolymers and hydroxypropyl methyl cellulose (HPMC). The polymer can have any weight average molecular weight, preferably from about 1000 to 1,000,000, or even form 10,000 to 300,000 or even form 15,000 to 200,000 or even form 20,000 to 150,000.

Mixtures of polymers can also be used. This may in particular be beneficial to control the mechanical and/or dissolution properties of the compartments or pouch, depending on the application thereof and the required needs. For example, it may be preferred that one polymer material has a higher water-solubility than another polymer material, and/or one polymer material has a higher mechanical strength than another polymer material. It may be preferred that a mixture of polymers is used, having different weight average molecular weights, for example a mixture of polyvinyl alcohol (PVA) or a copolymer thereof of a weight average molecular weight of 10,000–40,000, preferably around 20,000, and of PVA or copolymer thereof, with a weight average molecular weight of about 100,000 to 300,000, preferably around 150,000.

Also useful are polymer blend compositions, for example comprising a hydrolytically degradable and water-soluble polymer blend such as polylactide and polyvinyl alcohol, achieved by the mixing of polylactide and polyvinyl alcohol, typically comprising 1–35% by weight polylactide and approximately from 65% to 99% by weight polyvinyl alcohol, if the material is to be water-soluble.

It may be preferred that the polymer present in the film is from 60% to 98% hydrolysed, preferably 80% to 90%, to improve the dissolution of the material, and/or that the levels of plasticiser, including water, in the film are varied such that the dissolution is adjusted as required.

Most preferred is PVA film; preferably, the level of polymer in the film, for example a PVA polymer, is at least 60%. Such films typically comprise a PVA polymer with similar properties to the film known under the trade reference M8630 or CXP4087, as sold by Chris-Craft Industrial Products of Gary, Indiana, US. Preferably, the first pouch is made of a film material having the properties of PVA polymer-containing film M8630 and that the second pouch is made of material having similar properties as PVA-containing film CXP4087. Even more preferred are the materials M8630 and/or CXP4087 themselves. Other highly preferred PVA films useful herein are also available as "Solublon PT30" and "Solublon KA40" from Aicello Chemical Co., Ltd., Aichi, Japan.

The film herein may comprise other additive ingredients such as plasticisers (for example water glycerol, ethylene glycol, diethyleneglycol, propylene glycol, sorbitol and mixtures thereof), stabilisers, disintegrating aids, etc. If one or more of the compositions in the article is a cleaning composition, then the pouch material itself may comprise a cleaning agent or additive useful for cleaning compositions, to be delivered to the wash water, for example organic polymeric soil release agents, dispersants, dye transfer inhibitors.

Preferably, the pouch, in particular the first pouch is made of a material which is stretchable, as set out herein. This facilitates the closure of the open pouch, when is filled for more than 90% or even 95% by volume or even 100% or even over filled. Moreover, the material is preferably elastic, to ensure tight packing and fixation of the composition therein during handling, e.g. to ensure no (additional) head space can be form after closure of the compartment. Preferred stretchable materials have a maximum stretching degree of at least 150%, preferably at least 200%, and more preferably of at least 400% as determined by comparison of the original length of a piece of material just prior to rupture due to stretching, when a force of from about 1 to about 20 Newtons is applied to a piece of film with a width of 1 cm. Preferably, the material is such that it has a stretching degree as before, when a force of from about 2 to about 12 Newtons, and more preferably from about 3 to about 8 Newtons is used. For example, a piece of film with a length of 10 cm and a width of 1 cm and a thickness of 40 microns is stretched lengthwise with an increasing stress, up to the point that it ruptures. The extent of elongation just before rupture can be determined by continuously measuring the length and the degree of stretching can be calculated. For example, a piece of film with an original length of 10 cm which is stretched with a force of 9.2 Newton to 52 cm just before breaking, has a maximum stretching degree of 520%.

The force to stretch such a piece of film (10 cm×1 cm×40 microns) to a degree of 200% should preferably be within the ranges described above. This in particular ensures that the elastic force remaining in the film after forming the pouch or closing the pouch is high enough to pack the composition tightly within the pouch (but not so high that the film cannot be drawn into a vacuum mould of reasonable depth, when the pouch is made by a process involving the use of vacuum, such as by vacuum-forming or thermoforming).

As is clear form the definition herein, the stretchable material is defined by a degree of stretching measured when it is not present as a closed pouch. However, as said above, the material is preferably stretched when forming or closing the pouch. This can for example been seen by printing a grid onto the material, e.g. film, prior to stretching, then forming a pouch; it can be seen that squares of the grid are elongated and thus stretched.

The elasticity of the stretchable material can be defined as the 'elasticity recovery'. This can be determined by stretching the material for example to an elongation of 200%, as set out above, and measuring the length of the material after release of the stretching force. For example a piece of film of a length of 10 cm and width 1 cm and thickness of 40 microns is stretched lengthways to 20 cm (200% elongation) with a force of 2.8 Newtons (as above), and then the force is removed. The film snaps back to a length of 12 cm, which indicates an 80% elastic recovery. Preferably, the pouch material, in particular the first pouch, has an elasticity recovery of from about 20% to about 100%, more preferably from about 50% to about 100%, even more preferably from about 60% to about 100%, still more preferably from about 75% to about 100%, and even still more preferably form about 80% to about 100%.

Typically and preferably, the degree of stretching is non-uniform over the pouch, due to the formation and closing process. For example, when a film is positioned in a mould and an open pouch is formed by vacuum forming, the part of the film in the bottom of the mould, furthest removed form the points of closing, will be stretched more than in the top part. Another advantage of using stretchable and preferably also elastic material, is that the stretching action stretches the material non-uniformly, which results in a pouch which has a non-uniform thickness. This allows control of the dissolution/disintegration or dispersion of the pouches herein. Preferably, the material is stretched such that the thickness variation in the pouch formed of the stretched material is from 10 to 1000%, preferably 20% to 600%, or even 40% to 500% or even 60% to 400%. This can be measured by any method, for example by use of an appropriate micrometer.

In a preferred embodiment, the first pouch releases the first composition significantly earlier than the second pouch (or any subsequent pouches) releases the second composition. The term "significantly earlier", as used herein, indicates that the first composition is released at least about 30 seconds, preferably from about 45 seconds to about 10 minutes, and more preferably from about 60 seconds to about 5 minutes earlier than the second composition. Furthermore, the term "released" as used herein indicates that the pouch is ruptured, dissolved, and/or otherwise broken, preferably solely by interaction between the pouch material and water, so as to allow the composition contained therein to perform its function in water. Alternatively, the pouch may have a soluble seal which dissolves to release the pouch contents.

Preferably, the first pouch begins releasing its contents almost immediately upon contacting water in, for example, a washing machine. More preferably, the first pouch begins releasing its contents from about 1 second to about 120 seconds, even more preferably from about 5 seconds to about 60 seconds, after contacting the water. This embodiment is especially preferred where the first composition is intended to enhance the activity of the second composition by, for example, softening the water, removing otherwise reactive and/or undesirable ions, etc. Thus, in such an embodiment, a highly preferred first composition comprises a builder composition, a chelant, a chlorine ion sequesterant, or a combination thereof. Such compounds and/or compositions are per se known in the art. Such an embodiment provides significant manufacturing and logistics advantages, such as allowing a single base second composition (e.g., a base laundry detergent composition) to be produced, and yet allow easy customizing of the first composition to account for local variations in water hardness, chlorine levels, contaminant levels, etc. across many geographies. Such a surprising benefit gives a manufacturer the flexibility to use a single base composition many countries, and can save significant production, formulation, and logistics costs.

Additionally, delaying the release of the second pouch composition may allow the use of materials typically incompatible with the first pouch composition. For example a bleach and an enzyme. In this way, the first composition is allowed to act in solution before the second is released.

Process for Making Article and Pouches

The article of the invention is made by introducing a second pouch containing a composition in a first pouch, such that the first pouch encloses the second pouch completely. The process preferably comprises the steps of:

a) formation of the second pouch in open form, adding the second composition in said open second pouch and closing this to obtain the second pouch;

b) formation of the first pouch in open form, adding the second pouch and the first composition to the open first pouch and closing this first pouch to obtain the article.

The pouches can be made and filled by any process. The first pouch and preferably also the second pouch (and any further pouches which may be present) are preferably made by thermo-forming or even more preferably by vacuum-forming. Thermo-forming typically involves the step of formation of an open pouch in a mould under application of heat, which allows the material used for the pouch to take on the shape of the mould. Vacuum may be concurrently or separately used herein as well. Vacuum-forming typically involves the step of applying a (partial) vacuum on a mould which sucks the material into the mould and ensures the material adopts the shape of the mould.

Then, the open pouch in the mould is filled with the composition, and in the case of the first pouch, with the second pouch. The open pouch is then closed, typically with another piece of material, and sealed. The sealing can be done by any known method, for example by heat sealing, wetting, use of gluing agent, compression, or combinations thereof.

In an alternate embodiment of the process herein, the second pouch is not contained within the first pouch. Preferably the first pouch is placed side-by-side with the second pouch and sealed together on at least one side. However, in such an embodiment, it is essential that the first pouch be formed such that it still releases the first composition significantly earlier than the second pouch releases the second composition. Preferably, such a sequential release is the result of employing a quickly-dissolving film to form the first pouch, and a more slowly dissolving film to form the second pouch.

Process for Determining Releasing and Dissolving Times of the Pouch

Prepare a 2 L clear glass beaker containing 1.5 L deionized water at 25° C. Add a magnetic stirring rod set at 600 rpm and place the beaker in front of a white piece of paper/background. Prepare at least a first pouch containing sodium carbonate, and a second pouch containing additional sodium carbonate and an intense, water-soluble blue dye. Use a pH meter to continuously monitor the pH of the water in the beaker, while visually judging the color of the solution. Also prepare a timer.

Measure the base pH of the water prior to adding the first and second pouches. Upon simultaneously adding the pouches, start the timer. Continuously monitor the pH, noting the times when the pH begins to increase, and when the pH levels off. Also continuously monitor the color of the water from opposite the white paper/background, and note when the first indications of blue color appear. The first pH change indicates that the first composition is released from the first pouch, and the color change and second increase in pH indicate when the second composition is released from the second pouch. In addition, one can visually judge when the first and second pouches are completely dissolved.

As the stirring action of the stirring bar simulates actual in-use conditions, the above testing method is comparable to actual consumer use in, for example, a washing machine, a dishwashing machine, etc.

Compositions

The article herein comprises at least two compositions which are separated from one another, because they are enclosed by a different pouch. The compositions may have the same components and form, but of course, the benefit of the invention typically arises from the fact that two or more different compositions can be contained within one article. The article is useful for any operation whereby ingredients are to be introduced in solution, typically water. This includes health care products, agricultural products, including plant nutrients, food and drink products, fabric dyes or surface dyes. Preferred articles are for use in cleaning operations, such as automatic laundry, dish washing, hard-surface cleaning, hand wash, personal cleaning, and specialised fabric treatment compositions such as bleach additives, dye compositions, and fabric care compositions, such as fabric conditioners or softeners, perfume compositions, anti-wrinkling agents, and dry-cleaning aids. Preferred second but typically first compositions are cleaning compositions or fabric care compositions, preferably hard surface cleaners, more preferably laundry or dish washing compositions, including detergents, pre-treatment or soaking compositions, and other rinse additive compositions.

Highly preferred are articles which combine two or more types of compositions having two or more different purposes; for example, one composition being a cleaning composition and another composition being a perfume composition, bleach additive, dye of fabric softener or conditioner, or one composition being a perfume composition and the other composition being a bleach additive, fabric conditioner or softener. Also preferred may be that the division of ingredients per composition is done based on their chemical or physical compatibility, for example that the composition in the second pouch comprises selected cleaning ingredients which are not compatible with ingredients of the composition in the first pouch; for example, one composition may comprise bleach and the other composition bleach sensitive or reactive ingredients such as perfumes, enzymes, organic polymers, bleach catalysts.

The ingredients per composition may also be divided such that the first composition comprises ingredients to be delivered to the water first, and the other composition(s) comprises ingredients to be delivered at a later stage; for example, the first composition may contain surfactants, builder, enzymes and/or chelants, and the second composition may contain bleach, perfumes, fabric softener or conditioner, or mixtures thereof; the first composition may comprise a shampoo and the second a hair care product; the first composition may comprise a dish wash composition comprising builder, chelant, surfactant and/or enzymes and the second composition a rinse aid, glass care agent. Highly preferred are laundry or dish compositions whereby one pouch, typically the first, larger pouch, comprises cleaning agents and the second pouch comprises fabric care agents, such a conditioners or softeners, perfumes, anti-wrinkling agents, fabric benefit agents such as soil release polymers, fabric integrity polymers, sunscreens and/or the second pouch comprises additives such as bleach, fabric dyes. Preferably the first pouch comprises a laundry detergent comprising at least surfactant, preferably builder, and one or more of enzymes, bleach, chelants, suds suppressors and optional other ingredients, and the pouch comprises a silicon-based softener or a softening clay.

The first composition may be a liquid, non-aqueous liquid, gel, etc., which is transparent, so that the second pouch is visible. The second pouch or compositions therein may also have a distinctive colour, compared to the first pouch or composition therein. For example, the composition in the second pouch may comprise a (non fabric substantive) dye, whilst the first composition is colorless or comprises a different dye.

The compositions may also have a different physical state, for example, the first composition may be a liquid while the second composition is solid, or visa versa. Then, it may be beneficial to incorporate in one composition those ingredients which are liquid or are effectively and efficiently delivered in liquid solution or suspension, for example softening agents, liquid nonionic surfactants, perfume oils, water and other solvents, and in the other composition the solid ingredients, for example actives which are not very soluble in organic solvent or water, or even insoluble, or which are more efficiently or effectively delivered, incorporated or active in solid form: for example enzyme granules, bleach granules, insoluble builders and polymeric ingredients, salts of builders or surfactants, perfume granules, clay, effervescence sources.

Preferred ingredients in solid compositions or non-aqueous liquids are effervescence sources, capable of producing a gas upon contact with water, typically $CO_2$ gas, formed by reaction of a carbonate source and an acid source, preferably a carbonate salt and an organic carboxylic acid, such a citric acid, malic acid, maleic acid, glutaric acid, fumaric acid. Also preferred are other dissolution or dispensing aids, as known in the art.

If a liquid composition is present, it preferably comprises only small amounts of water, up to 8% or even up to 6% or up to 4% by weight of the composition. Preferably, other solvents are present, such as alcohols, glycerine, polyethylene glycol, paraffin.

If the first or second component comprises a liquid composition, it is preferred that this pouch comprising the liquid composition has a small air bubble, preferably the air bubble has a volume of no more than 20%, preferably no more than 10%, more preferably no more than 5% of the volume enclosed by said pouch. Such a air bubble provides improved resistance to rupture caused by, for example, heat, freezing, compression, etc. during shipping.

Preferred Ingredients of Fabric Treatment, Cleaning and Care Compositions

The first and/or second composition typically comprises a surfactant. Preferred surfactants are selected from anionic, nonionic, cationic, ampholytic, amphoteric and zwitterionic surfactants and mixtures thereof. A typical listing of anionic, nonionic, ampholytic, and zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch). A list of suitable cationic surfactants is given in U.S. Pat. No. 4,259,217 issued to Murphy on Mar. 31, 1981. Preferably the compositions comprise from 5% more preferably from 10%, yet more preferably from 15%, to 80%, more preferably to 50%, yet more preferably to 30% by weight of the composition of surfactant.

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof. Anionic sulfate surfactants suitable for use herein include the linear and branched primary and secondary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and —N-($C_1$–$C_2$ hydroxyalkyl) glucamine sulfates, and sulfates of alkylpolysaccharides such as the sulfates of alkylpolyglucoside (the nonionic nonsulfated compounds being described herein). Alkyl sulfate surfactants are preferably selected from the linear and branched primary $C_{10}$–$C_{18}$ alkyl sulfates, more preferably the $C_{11}$–$C_{15}$ branched chain alkyl sulfates and the $C_{12}$–$C_{14}$ linear chain alkyl sulfates. Alkyl ethoxysulfate surfactants are preferably selected from the group consisting of the $C_{10}$–$C_{18}$ alkyl sulfates which have been ethoxylated with from 0.5 to 20 moles of ethylene oxide per molecule. More preferably, the alkyl ethoxysulfate surfactant is a $C_{11}$-$C_{18}$, most preferably $C_{11}$–$C_{15}$ alkyl sulfate which has been ethoxylated with from 0.5 to 7, preferably from 1 to 5, moles of ethylene oxide per molecule. A particularly preferred aspect of the invention employs mixtures of the preferred alkyl sulfate and/or sulfonate and alkyl ethoxysulfate surfactants, such as described in PCT Patent Application No. WO 93/18124.

Essentially any alkoxylated nonionic surfactants are suitable herein. The ethoxylated and propoxylated nonionic surfactants are preferred. Preferred alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts. The condensation products of aliphatic alcohols with from 1 to 25 moles of alkylene oxide, particularly ethylene oxide and/or propylene oxide, are also suitable for use herein. The alkyl chain of the aliphatic alcohol can either be straight or branched, primary or secondary, and generally contains from 6 to 22 carbon atoms. Particularly preferred are the condensation products of alcohols having an alkyl group containing from 8 to 16 carbon atoms.

When the article herein is a bleach additive, it preferably comprises a mixture of bleaching agents, preferably also chelating agents and optionally other ingredients. When the article is a fabric cleaning article, the first and/or second composition preferably comprise a bleaching agent or mixture thereof. Preferably, one composition comprises a bleach activator or peracid bleach and the other composition a peroxygen bleach, or one composition comprises a bleach activator, peracid and/or a peroxygen bleach and the other composition a bleach catalyst.

Preferably the cleaning compositions comprise from 3% more preferably from 5%, yet more preferably from 10%, to 40%, more preferably to 25%, yet more preferably to 20% by weight of the composition of bleaching agent; bleach additive compositions preferably comprise from 20% more preferably from 30%, yet more preferably from 30%, to 100%, more preferably to 90% by weight of the composition of bleaching agent.

The first and/or second composition herein preferably comprises a bleach activator, preferably comprising an organic peroxyacid bleach precursor, or mixtures thereof. The production of the organic peroxyacid occurs then by an in situ reaction of the precursor with a source of hydrogen peroxide. The bleach may alternatively, or in addition comprise a preformed peroxy acid bleach.

Suitable N-acylated lactam perbenzoic acid precursors have the formula:

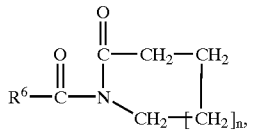

wherein n is from 0 to 8, preferably from 0 to 2, and $R^6$ is a benzoyl group.

A preferred class of substituted perbenzoic acid precursor compounds are the amide substituted compounds of the following general formulae:

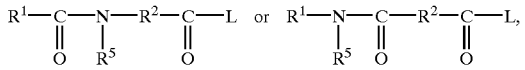

wherein $R^1$ is an aryl or alkaryl group with from 1 to 14 carbon atoms, $R^2$ is an arylene, or alkarylene group containing from 1 to 14 carbon atoms, and $R^5$ is H or an alkyl, aryl, or alkaryl group containing 1 to 10 carbon atoms and L can be essentially any leaving group. $R^1$ preferably contains from 6 to 12 carbon atoms, and may be aryl, substituted aryl or alkylaryl containing branching, substitution, or both and may be sourced from either synthetic sources or natural sources including for example, tallow fat. $R^2$ preferably contains from 4 to 8 carbon atoms. Analogous structural variations are permissible for $R^2$. The substitution can include alkyl, aryl, halogen, nitrogen, sulphur and other typical substituent groups or organic compounds. $R^5$ is preferably H or methyl. $R^1$ and $R^5$ should not contain more than 18 carbon atoms in total. Amide substituted bleach activator compounds of this type are described in EP-A-0170386.

The hydrophobic peroxy acid bleach precursor preferably comprises a compound having a oxy-benzene sulphonate group, preferably nonanoyl oxy-benzene sulphonate (NOBS), decanoyl oxy-benzene sulphonate (DOBS) and/or comprising (6-nonamidocaproyl) oxybenzene sulfonate (NACA-OBS). Also highly preferred are more hydrophilic peroxy acid bleach precursors or activators such as TAED.

Also preferred bleaching agent for use herein are particulate peracids, such as various pre-formed mono peroxycarboxylic acids. In an even more preferred embodiment the pre-formed peracid is phthaloyl amido peroxyhexanoic acid (PAP).

The bleach activator or precursor and/or the pre-formed peracid is preferably used in particulate form, or as a particle, suspended in a liquid matrix. The liquid matrix is substantially non-aqueous, meaning that it does not comprise a level of water that would result in the dissolution of the bleach precursor or peracid. Preferred suspending agents are solvents which do not either dissolve or damage the pouches. More preferably, the suspending agent is a long chain (e.g., >6 carbon atoms), low polarity (e.g., dielectric constant of less than 40) solvent. Preferred solvents include $C_{12-14}$ paraffin and more preferably $C_{12-14}$ isoparaffin.

Examples of inorganic perhydrate salts include perborate, percarbonate, perphosphate, persulfate and persilicate salts. The inorganic perhydrate salts are normally the alkali metal salts. The inorganic perhydrate salt may be included as the crystalline solid without additional protection. For certain perhydrate salts however, the preferred executions of such granular compositions utilize a coated form of the material which provides better storage stability for the perhydrate salt in the granular product. Suitable coatings comprise inorganic salts such as alkali metal silicate, carbonate or borate salts or mixtures thereof, or organic materials such as waxes, oils, or fatty soaps.

Sodium perborate (a perhydrate salt in the form of the monohydrate of nominal formula $NaBO_2H_2O_2$ or the tetrahydrate $NaBO_2H_2O_2.3H_2O$), may be used, but is not compatible with certain pouch materials with —OH groups, such as PVA, and is thus often not preferred. Alkali metal percarbonates, particularly sodium percarbonate are preferred perhydrates herein. Sodium percarbonate is an addition compound having a formula corresponding to $2Na_2CO_3.3H_2O_2$, and is available commercially as a crystalline solid.

Chloride bleaches may also be useful, in particle when the article is a bleach additive or hard surface cleaner. Suitable bleaches are hypochlorite species in aqueous solution include alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium bypochlorite, dibasic magnesium hypochlorite, chlorinated trisodium phosphate dodecahydrate, potassium dichloroisocyanurate, sodium dichloroisocyanurate sodium dichloroisocyanurate dihydrate, trichlorocyanuric acid, 1,3-dichloro-5,5-dimethylhydantoin, N-chlorosulfamide, Chloramine T, Dichloramine T, chloramine B and Dichloramine B. A preferred bleaching agent is sodium hypochlorite, potassium hypochlorite, or a mixture thereof. A preferred chlorine-based bleach is Triclosan (trade name). The compositions described herein which contain bleach as detergent component preferably contain a metal containing bleach catalyst. Preferably the metal containing bleach catalyst is a transition metal containing bleach catalyst, more preferably a manganese or cobalt-containing bleach catalyst. Preferably the compositions comprise from 1 ppb (0.0000001%), more preferably from 100 ppb (0.00001%), yet more preferably from 500 ppb (0.00005%), still more preferably from 1 ppm (0.0001%) to 99.9%, more preferably to 50%, yet more preferably to 5%, still more preferably to 500 ppm (0.05%) by weight of the composition, of a metal bleach catalyst. Such catalysts are disclosed in U.S. Pat. No. 4,430,243. Preferred types of bleach catalysts include the manganese-based complexes disclosed in U.S. Pat. Nos. 5,246,621, 5,244,594, and European Patent Application No. 549,272 A. Preferred examples of these catalysts include $Mn^{IV}_2(u\text{-}O)_3$ (1,4,7-trimethyl-1,4,7-triazacyclononane)$_2$-$(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$-(1,4,7-trimethyl-1,4,7-triazacyclononane)$_2$-$(ClO_4)_3$, and mixtures thereof. Other ligands suitable for use herein include 1,5,9-trimethyl-1,5,9-triazacyclododecane, 2-methyl-1,4,7-triazacyclononane, 2-methyl-1,4,7-triazacyclononane, 1,2,4,7-tetramethyl-1,4,7-triazacyclononane, and mixtures thereof. Also useful are water-soluble complexes of manganese (III), and/or (IV) with a non-carboxylate polyhydroxy ligand having at least three consecutive C—OH groups, such as sorbitol, iditol, dulsitol, mannitol, xylithol, arabitol, adonitol, meso-erythritol, meso-inositol, lactose, and mixtures thereof; see U.S. Pat. No. 5,114,606. Also useful are bleach catalysts comprising a transition metal complex, including Mn, Co, Fe, or Cu, with an non-(macro)-cyclic ligand such as described in U.S. Pat. No. 5,114,611. Other highly preferred catalysts include Co(2,2'-bispyridylamine)$Cl_2$, Di(isothiocyanato)bispyridylamine-cobalt(II), trisdipyridylamine-cobalt(II) perchlorate, Co(2,2-bispyridylamine)$_2O_2ClO_4$, Bis-(2,2'-bispyridylamine)

copper(II) perchlorate, tris(di-2-pyridylamine)iron(II) perchlorate, and mixtures thereof.

Cobalt (III) catalysts and cobalt (II) catalysts with a reduction potential under alkaline conditions of less than 0.4 volts (preferably less than 0.2 volts) versus a normal hydrogen electrode are also useful herein. The preferred cobalt catalyst of this type useful herein are cobalt pentaamine chloride salts described in M. L. Tobe, "Base Hydrolysis of Transition-Metal Complexes", *Adv. Inorg. Bioinorg. Mech.*, (1983), 2, pages 1–94. The most preferred cobalt catalyst useful herein are cobalt pentaamine acetate salts having the formula $[Co(NH_3)_5OAc]\ T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$ (herein "PAC"). A further description of the bleach catalysts useful herein can be found in WO 98/39406 A1, published Sep. 11, 1998, WO 98/39098 A1, published Sep. 11, 1998, and WO 98/39335 A1, published Sep. 11, 1998, all of which are included herein by reference. Opacifying agents and/or dyes, and dyed particles or speckles for solid compositions are also useful herein. The dye as used herein can be a dyestuff or an aqueous or nonaqueous solution of a dyestuff. Specific examples of suitable dyestuffs include E104—food yellow 13 (quinoline yellow), E110—food yellow 3 (sunset yellow FCF), E131—food blue 5 (patent blue V), Ultra Marine blue (trade name), E133—food blue 2 (brilliant blue FCF), E140—natural green 3 (chlorophyll and chlorphyllins), E141 and Pigment green 7 (chlorinated Cu phthalocyanine). Preferred dyestuffs may be Monastral Blue BV paste (trade name) and/or Pigmasol Green (trade name).

Also useful herein a fabric substantive dyes to provide dyeing of fabrics treated with the article of the invention. For example, the second pouch may comprise such a dye, while the first pouch may comprise a cleaning agent or dye auxiliary agents.

Another preferred ingredient of the compositions herein is a perfume oil or perfume composition. Any perfume oil or composition can be used herein. The perfumes may also be encapsulated. The second pouch preferably comprises the perfume, so that this is delivered at a later stage, to ensure a more efficient delivery of the perfume to a fabric. Preferred are perfume compositions comprising perfume oils and a carrier material, for example as described in JP-56075159, describing the combination of methacrylonitrilebutadiene-styrene tertiary polymer with a liquid perfume; GB2141726, DE 3247709; WO 97/34982; WO 94/19449; WO 98/28398. Preferably, the carrier is a water-insoluble polymer, preferably selected from polymers which have chemically reacted with the perfume ingredient, to make the carrier as above mentioned. Preferably the cleaning compositions comprise from 0.05% to 15%, more preferably from 1% to 10% by weight of the composition of perfume oil or perfume composition.

The compositions herein preferably contain a heavy metal ion sequesterant or chelant or chelating agent. By heavy metal ion sequesterant it is meant herein components which act to sequester (chelate) heavy metal ions. These components may also have calcium and magnesium chelation capacity, but preferentially they show selectivity to binding heavy metal ions such as iron, manganese and copper. Suitable heavy metal ion sequesterants for use herein include organic phosphonates, such as the amino alkylene poly (alkylene phosphonates), alkali metal ethane 1-hydroxy disphosphonates and nitrilo trimethylene phosphonates, nitrilotriacetic acid and polyaminocarboxylic acids such as ethylenediaminotetracetic acid, ethylenediamine disuccinic acid, ethylenediamine diglutaric acid, 2-hydroxypropylenediamine disuccinic acid or any salts thereof, preferably diethylene triamine penta (methylene phosphonate), ethylene diamine tri (methylene phosphonate), hexamethylene diamine tetra (methylene phosphonate) and hydroxy-ethylene 1,1 diphosphonate, 1,1 hydroxyethane diphosphonic acid and 1,1 hydroxyethane dimethylene phosphonic acid. Heavy metal ion sequesterants are generally present at a level of from 0.005% to 10%, preferably from 0.1% to 5%, more preferably from 0.25% to 7.5% and even more preferably from 0.3% to 2% by weight of the compositions.

Other suitable heavy metal ion sequesterants for use herein are iminodiacetic acid derivatives such as 2-hydroxyethyl diacetic acid or glyceryl imino diacetic acid, described in EP-A-317,542, EP-A-399,133, EP-A-516,102 and EP-A-528,859, and the β-alanine-N,N'-diacetic acid, aspartic acid-N,N'-diacetic acid, aspartic acid-N-monoacetic acid and iminodisuccinic acid sequesterants described in EP-A-509,382. Other amino based sequesterants (EP-A-476,257), collagen, keratin or casein sequesterants (EP-A-510,331), Dipicolinic acid and 2-phosphonobutane-1,2,4-tricarboxylic acid, Glycinamide-N,N'-disuccinic acid (GADS), ethylenediamine-N-N'-diglutaric acid (EDDG) and 2-hydroxypropylenediamine-N-N'-disuccinic acid (HPDDS) are also suitable. Especially preferred are diethylenetriamine pentacetic acid, ethylenediamine-N,N'-disuccinic acid (EDDS) and 1,1 hydroxyethane diphosphonic acid or the alkali metal, alkaline earth metal, ammonium, or substituted ammonium salts thereof, or mixtures thereof. In particular the chelating agents comprising a amino or amine group can be bleach-sensitive and are suitable in the compositions of the invention.

Another highly preferred ingredient useful in the compositions herein is one or more additional enzymes. Preferred additional enzymatic materials include the commercially available lipases, cutinases, amylases, neutral and alkaline proteases, cellulases, endolases, esterases, pectinases, lactases and peroxidases conventionally incorporated into detergent compositions. Suitable enzymes are discussed in U.S. Pat. Nos. 3,519,570 and 3,533,139. Preferred commercially available protease enzymes include those sold under the tradenames Alcalase, Savinase, Primase, Durazyme, and Esperase by Novo Industries A/S (Denmark), those sold under the tradenames Maxatase, Maxacal and Maxapem by Gist-Brocades, those sold by Genencor International, and those sold under the tradenames Opticlean and Optimase by Solvay Enzymes. Protease enzyme may be incorporated into the compositions in accordance with the invention at a level of from 0.0001% to 4% active enzyme by weight of the composition.

Preferred amylases include, for example, α-amylases obtained from a special strain of B licheniformis, described in more detail in GB-1,269,839 (Novo). Preferred commercially available amylases include for example, those sold under the tradename Rapidase by Gist-Brocades, and those sold under the tradename Termamyl, Duramyl and BAN by Novo Industries A/S. Highly preferred amylase enzymes maybe those described in PCT/US 9703635Published as WO 97/32961, and in WO 95/26397 and WO 96/23873. Amylase enzyme may be incorporated into the composition at a level from 0.0001% to 2% active enzyme by weight.

Lipolytic enzymes may be present at levels of active lipolytic enzyme of from 0.0001% to 2% by weight, preferably 0.001% to 1% by weight, and more preferably from 0.001% to 0.5% by weight. The lipase may be fungal or bacterial in origin being obtained, for example, from a lipase producing strain of Humicola sp., Thermomyces sp. or Pseudomonas sp. including *Pseudomonas pseudoalcaligenes* or *Pseudomonas fluorescens*. Lipase from chemically or genetically modified mutants of these strains are also useful herein. A preferred lipase is derived from *Pseudomonas pseudoalcaligenes*, which is described in Granted European Patent, EP-B-0 218 272. Another preferred lipase herein is obtained by cloning the gene from *Humicola lanuginosa* and expressing the gene in *Aspergillus oryza*, as host, as described in European Patent Application, EP-A-0258 068, which is commercially available from Novo Industri A/S, Bagsvaerd, Denmark, under the trade name Lipolase. This lipase is also described in U.S. Pat. No. 4,810,414, Huge-Jensen et al, issued Mar. 7, 1989.

Builders are also useful herein. A phosphate-containing builder material useful herein and preferably comprises tetrasodium pyrophosphate or even more preferably anhydrous sodium tripolyphosphate. Also preferred herein are builders, such as water-soluble and water-insoluble builders. Preferred water-insoluble builders, typically for solid compositions herein are alumino silicates such as zeolites (zeolite A, MAP, P, X) and layered silicates such as known as SKS-6, sold by Clariant. Suitable water-soluble builder compounds include the water soluble monomeric polyvcarboxylates, or their acid forms, homo or copolymeric polycarboxylic acids or their salts in which the polycarboxylic acid comprises at least two carboxylic radicals separated from each other by not more that two carbon atoms, and mixtures of any of the foregoing. Examples of preferred polycarboxylate builders are found in British Patent No. 1,379,241, British Patent No. 1,389,732, Netherlands Application 7205873, and in British Patent No. 1,387,447. The most preferred polycarboxylic acid containing three carboxy groups is citric acid, preferably present at a level of from 0.1% to 15%, more preferably from 0.5% to 8% by weight. Polycarboxylates containing four or more carboxy groups and sulfo substituents, including sulfosuccinates, are also useful herein.

The parent acids of the monomeric or oligomeric polycarboxylate chelating agents or mixtures thereof with their salts, e.g. citric acid or citrate/citric acid mixtures are also contemplated as useful builder components.

Suitable examples of water-soluble phosphate builders are the alkali metal tripolyphosphates, sodium, potassium and ammonium pyrophosphate, sodium and potassium and ammonium pyrophosphate, sodium and potassium orthophosphate, sodium polymeta/phosphate in which the degree of polymerization ranges from about 6 to 21, and salts of phytic acid.

A combination of calcite and sodium carbonate is especially useful in the first pouch in order to provide water softening/builder benefits. If present, the calcite typically comprises from about 0.5% to about 50%, preferably from about 1% to about 30%, and more preferably from about 2% to about 10% of the composition. Such calcite is commercially available, for example, from Wujin Calcite Factory, Jiangsu Province, China. Similarly, sodium carbonate typically comprises from about 40% to about 99.5%, preferably from about 65% to about 99%, and more preferably from about 80% to about 98% of the composition. Such sodium carbonate is commercially available, for example, from Tianjin Soda Plant., Tianjin, China. The first pouch may also contain other ingredients, for example, alternative builders, polymers, anionic, non-ionic and/or cationic surfactants, enzymes, bleaching agents and/or brightening agents.

Other preferred calcite/carbonate builders include encapsulated and/or non-encapsulated crystalline and/or calcite builders such as those described in U.S. Pat. No. 6,114,289 to Capeci and Pancheri, issued on Sep. 5, 2000; U.S. Pat. No. 6,100,232 to Capeci and Pancheri, issued on Aug. 8, 2000; WO 98/40455 to Pancheri and Rohrbaugh, published on Sep. 17, 1998; U.S. Pat. No. 5,733,865 to Pancheri, et al., issued on Mar. 31, 1998; U.S. Pat. No. 5,731,279 to Pancheri, issued on Mar. 24, 1998; U.S. Pat. No. 5,707,959 to Pancheri, et al., issued on Jan. 13, 1998; and U.S. Pat. No. 5,658,867 to Pancheri and Burckett-St. Laurent, issued on Aug. 19, 1997. Citric acid may be optionally combined with the calcite and sodium carbonate to provide a buffering benefit.

Also preferred in cleaning compositions or fabric care or conditioning compositions are fabric integrity polymers such as cyclic amine based polymers, including adducts of two or more compositions selected from the group consisting of piperazine, piperadine, epichlorohydrin, epichlorohydrin benzyl quat, epichlorohydrin methyl quat, morpholine and mixtures thereof.

Highly preferred cyclic amine based polymers herein are the linear or branched imidazole-epichlorohydrin copolymers. One specific type of branching can be introduced using a polyfunctional crosslinking agent. An example of such polymer is exemplified below.

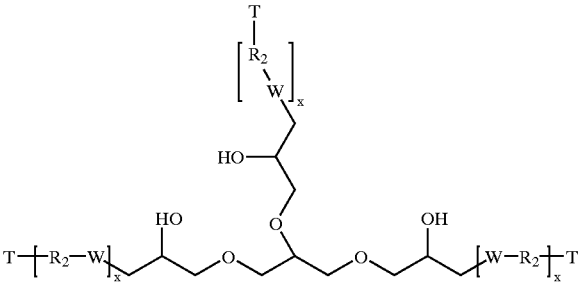

This material will generally be about 0.01% to about 10% by the weight of the detergent composition or component, more preferably from 0.05% to 6% or even from 0.05% to 3%.

The compositions herein may also comprise as soil release or fabric integrity agents, a salt of an anionic cellulose material comprising an anionic substituent group R—X—Z wherein R is a saturated, unsaturated or aromatic hydrocarbon spacer group, X is oxygen, nitrogen or sulphur, Z is carboxylate, sulphonate, sulphate or phosphonate group. The hydrocarbon spacer group is preferably a $C_1$–$C_{18}$, more preferably a $C_1$–$C_{14}$, or even more preferably a $C_1$–$C_4$ saturated, unsaturated or aromatic group, preferably an alkylene group. The spacer group may also be substituted with one or more hydroxy groups. The group X is preferably a nitrogen, or even more preferably an oxygen atom. The group Z is preferably a carboxylate group. Highly preferred hereon are the so-called salts of carboxyalkyl celluloses, whereby preferably the alkyl group comprises from 1 to 4 carbon atoms. Highly preferred herein is a potassium or sodium salt of carboxymethyl cellulose. The anionic cellulose material will generally be about 0.01% to about 10% by the weight of the detergent composition or component, more preferably from 0.05% to 6% or even from 0.05% to 3% by weight of a composition.

The softening ingredients useful herein, in particular when the article is a fabric care composition or a fabric cleaning composition also giving softening, may be selected from any known ingredients that provides a fabric softening benefit, such as smectites clay minerals with a 14Å x-ray diffraction pattern having the formulas $Al_2(Si_2O_5)_2(OH)_2$ and $Mg_3(Si_2O_5)(OH)_2$ for the aluminum and magnesium oxide type clay, respectively. It is to be recognised that the range of the water of hydration in the above formulas can vary with the processing to which the clay has been subjected. Furthermore, atom substitution by iron and magnesium can occur within the crystal lattice of the smectites, while metal cations such as Na+, Ca++, as well as H+, can be co-present in the water of hydration to provide electrical neutrality. Smectites, such as montmorillonite and bentonite, having an ion exchange capacity of around 70 meq/100 g., and montmorillonite, which has an ion exchange capacity greater than 70 meq/100 g., have been found to be useful in the instant compositions in that they are deposited on the fabrics to provide the desired softening benefits. Accordingly, clay minerals useful herein can be characterised as expandable, three-layer smectite-type clays having an ion exchange capacity of at least about 50 meq/100 g. Smectite clays are disclosed in U.S. Pat. Nos. 3,862,058, 3,948,790, 3,954,632 and 4,062,647. The smectite clays used in the compositions herein are commercially available as, for example, montmorillonite, volchonskoite, nontronite, hectorite, saponite, sauconite, and vermiculite. The clays herein are available under various tradenames, for example, Thixogel #1® and Gelwhite GP® from Georgia Kaolin Co., Elizabeth, N.J.; Volclay BC® and Volclay #325®, from American Colloid Co., Skokie, Ill.; Black Hills Bentonite BH450®, from International Minerals and Chemicals; and Veegum Pro and Veegum F, from R. T. Vanderbilt. European Patents No.s EP-A-299,575 and EP-A-313,146 also describe suitable organic polymeric clay flocculating agents.

The clay is preferably in the form of granules, with at least 50%, preferably at least 75%, and more preferably at least 90% being in the form of granules having a size of at least 0.1 mm up to 1.8 mm, preferably up to 1.18 mm, and more preferably from 0.15 mm to 0.85 mm. Preferably the amount of clay in the granules is at least 50%, more preferably at least 70% and most preferably at least 90% by weight of the granules.

Other suitable softening ingredients are long chain polymers and copolymers derived from monomers such as ethylene oxide, acrylamide, acrylic acid, dimethylamino ethyl methacrylate, vinyl alcohol, vinyl pyrrolidone and/or ethylene imide, especially polymers of ethylene oxide, acrylamide and acrylic acid. These polymers preferably have average molecular weight in the range of from 100 000 to 10 million, more preferably from 150 000 to 5 million, as measured using gel permeation chromatography, against standards of polyethylene oxide of narrow molecular weight distributions. The most preferred polymers are polyethylene oxides.

Other suitable softening ingredients include cationic fabric softening agents which are suitable for use in methods of laundry washing. Suitable cationic fabric softening agents include the water insoluble tertiary amines or di-long chain amide materials as disclosed in GB-A-1 514 276 and EP-B-0 011 340.

Neutralizing agents, buffering agents, including (bi) carbonate salts, phase regulants, hydrotropes, enzyme stabilizing agents, polyacids, suds regulants, opacifiers, antioxidants, bactericides, such as those described in U.S. Pat. No. 4,285,841 to Barrat et al., issued Aug. 25, 1981 (herein incorporated by reference), can also be present.

EXAMPLE I

A mould is used which consists of a cylindrical shape and has a diameter of 10 mm and a depth of 8 mm. A 0.5 mm thick layer of rubber is present around the edges of the mould. The mould has some holes in the mould material to allow a vacuum to be applied. A piece of Chris-Craft M-8630 or CXP4087 film is placed on top of this mould and fixed in place. A vacuum is applied to pull the film into the mould and pull the film flush with the inner surface of the mould. Composition B or D (see below) is poured into the mould, preferably in an amount to almost or completely fill the mould. Then, another piece of the same film material is placed over the mould and sealed to the first piece of film by applying an annular piece of heated flat under moderate pressure onto the ring of rubber at the edge of the mould to heat-seal the two pieces of film together to form the second pouch.

Another mould is used which consists of a cylindrical shape and has a diameter of 45 mm and a depth of 25 mm. A 1.0 mm thick layer of rubber is present around the edges of the mould. The mould has some holes in the mould material to allow a vacuum to be applied. A piece of Chris-Craft M-8630 film is placed over the top of this mould and a vacuum is applied to pull the film into the mould and pull the film flush with the inner surface of the mould. Pouch B above and a composition A or C (see below) is poured into the mould, preferably in an amount to almost or completely fill the mould. Then, another piece of the same film material is placed over the mould and sealed to the first piece of film by applying an annular piece of heated flat under moderate pressure onto the ring of rubber at the edge of the mould to heat-seal the two pieces of film together to form the first pouch and thus the article herein. (The metal ring is typically heated to a temperature of from 135° C. to 150° C. and applied for up to 5 seconds.)

This process can be modified by using other methods of forming the shape of the pouches, other types of film, other sizes of mould, sealing methods, more individual pouches etc.

The following are possible compositions A and B, C and D as useful in the process above. Typically, composition A and B, C and D are used in amount to suit unit dosage, such that the moulds used above and the resulting pouches are filled by at least 90% by volume. Other compositions can be formulated to be equally suitable.

Any combination of A1 to A6 with any of B1 to B8 is possible, combination A5 and A6 with B1 or B3 being less preferred. C1 is typically combined with D1; C2 is typically combined with D2; C3 is typically combined with D3; C4 is typically combined with D4.

| | Amount (by weight of the liquid component) | | | | | |
|---|---|---|---|---|---|---|
| Liquid composition A | A1 | A2 | A3 | A4 | A5 | A6 |
| Liquid Nonionic surfactant | 15% | 40% | — | 74% | | 10% |
| Solvent (alcohol, glycerol) | 15% | 30% | 20% | 12% | 30% | 20% |
| Perfume | 5% | — | 7% | 7% | | |
| Water | 5% | 10% | 3% | 2% | | 5% |
| Chelant | 5% | 5% | 10% | — | 15% | 5% |
| Soluble builder phosphate, fatty acids | 35% | 15% | 30% | — | | 15% |
| Anionic surfactant | 20% | — | 30% | — | 10% | 10% |
| Percarbonate | — | — | — | — | 35% | 30% |
| TAED, peracid, or catalyst | — | — | — | — | 10% | 5% |
| Minors | | | | | | |

| | Amount (by weight of the solid/liquid component) | | | | | | | |
|---|---|---|---|---|---|---|---|---|
| Composition B | B1 | B2 | B3 | B4 | B5 | B6 | B7 | B8 |

-continued

| | | | | | | | | |
|---|---|---|---|---|---|---|---|---|
| Percarbonate | 40% | — | 40% | — | — | — | — | — |
| Chelating agent | 10% | 20% | 10% | — | — | 15% | — | — |
| Enzyme | — | 50% | — | 20% | 15% | — | — | |
| Cationic softener | — | — | — | 20% | — | 10% | 60% | — |
| Bleach activator | 20% | — | 15% | — | — | — | — | — |
| Solvent | — | 20% | — | 10% | 25% | — | — | 40% |
| Water | — | — | 5% | — | — | 3% | 30% | — |
| Surfactant | — | — | — | 30% | — | — | — | — |
| Perfume | | 10% | 5% | 20% | 10% | 12% | 10% | 60% |
| Silicone-softener | — | — | — | — | 50% | — | — | — |
| softening clay (bentonite) | — | — | 25% | | — | 60% | — | — |
| Minors | | | | | | | | |

| Composition C (solid) | C1 | C2 | C3 | C4 |
|---|---|---|---|---|
| Percarbonate | 15% | 50% | — | |
| TAED | 10% | — | — | — |
| Clay softener and/or cationic softener and/or silicone softener | 35% | — | 65% | — |
| Polyethylene oxide of av. mol. Wt. 500 000 | 5% | — | 10% | — |
| citric acid | 20% | 30% | 10% | 35% |
| Bicarbonate/carbonate | 15% | 20% | 10% | 35% |
| Perfume | | | 5% | 30% |

| Composition D (liquid) | D1 | D2 | D3 | D4 |
|---|---|---|---|---|
| Organic solvent or suspending aid | 60% | 40% | 50% | 30% |
| Bleach catalyst | 10% | 5% | — | — |
| PAP | 20% | 20% | — | — |
| NOBS/NACA-OBS | 10% | 35% | — | — |
| Perfume | — | — | 40% | — |
| Enzymes | | | 10% | 10% |
| Surfactant | | | | 60% |
| Minors up to 100% | | | | |

EXAMPLE II

A first pouch is made from water-soluble polyvinyl alcohol film material supplied as "Solublon PT30" from Aicello Chemical Co., Ltd., Aichi, Japan, by folding a 8 cm×8 cm square of film in half, and then heat-sealing the 2 opposing free edges to form a rectangular 8 cm×4 cm pouch with an open mouth. 2 g of calcite from Wujin Calcite Factory, Jiangsu Province, China, and 10 g of sodium carbonate from Tianjin Soda Plant, Tianjin, China are then added into the open mouth of the pouch, the excess air pressed out, and the mouth is heat-sealed shut.

A second pouch is formed, starting with a 8 cm×16 cm rectangle of a second water-soluble polyvinyl alcohol film material supplied as "Solublon KA40" from Aicello Chemical Co., Ltd., Aichi, Japan. The rectangle is folded in half to form a 8 cm×8 cm square which is then heat-sealed along 2 sides, and then filled with 30 g of granular laundry detergent having the composition described below. The mouth of the second pouch is then simultaneously pressed against the sealed mouth of the first pouch and heat-sealed, so as to seal the second pouch and to fuse the two pouches together. Accordingly, a single unit-dose laundry detergent containing two water-soluble pouches sealed side-by-side is formed.

The detergent composition in the second pouch has the formula:

| | wt % |
|---|---|
| Linear alkyl benzene sulfonate | 20 |
| Non-ionic surfactant | 1.6 |
| Zeolite | 6 |
| Fluorescent brightener | 0.2 |
| Polyacrylate | 3 |
| Chelating agent | 0.3 |
| NOBS | 2.2 |
| Perborate | 3 |
| Enzymes | 1 |
| Sodium carbonate | 11.4 |
| Filler | 13.5 |
| Perfume, minors | balance |

When added to an automatic laundry washing machine containing 33 L of water having a hardness of 16 grains per gallon (4.2 grains per liter) and a temperature of 25° C., the first pouch ruptures and thus begins releasing its contents within 30 seconds. The calcite and sodium carbonate then interact with the water to chelate the hardness ions and thereby soften the water. The second pouch ruptures and thus begins releasing its contents after about 90 seconds.

Such a composition provides significantly improved cleaning as the builder has sufficient time to effectively remove hard water ions which would otherwise interfere with the cleaning performance of the granular detergent composition, as compared to a detergent composition where the builder and detergent ingredients are included together and contact the water at the same time.

A first and second pouch, as described in this example are tested according to the procedure described herein. The first and second pouches are connected together, and thus are added to the beaker at the same time. The first pouch contains sodium carbonate, and the second pouch contains sodium carbonate and blue zinc phthalocyanine sulfonate particles. The first pouch begins releasing its contents within about 5 seconds, and reaches a level pH of 11, about 25 seconds after the pouches are added to the water in the beaker. 30 seconds after the pouches are added to the water, the first pouch is totally dissolved. The pH remains at 11, until 60 seconds after the pouches are added to the beaker. Then, the water starts to appear blue, indicating that the second pouch has released its contents. 75 seconds after adding the pouches to the water, the second pouch only remains as floating remnants, the water is blue, and has a pH of 11.5. 90 seconds after adding the pouches to the beaker, the second pouch is completely dissolved, the water is blue, and the pH is 11.5.

What is claimed is:

1. An article comprising a first pouch made of a water-soluble material comprising a polyvinyl alcohol polymer, which comprises in its interior a) a first solid or liquid composition; and b) a second pouch made of a water-reactive material, comprising in its interior a second liquid composition;

whereby the first pouch and the second pouch are made by thermo-forming or vacuum-forming.

2. An article as in claim 1 whereby the first and second pouch are made of the same or different water-soluble material, comprising a polyvinyl alcohol polymer.

3. An article as in claim 1 whereby the second pouch is made of a material which dissolves slower in water than the material of the first pouch.

4. An article as in claim 3 whereby the first pouch is made of a different material than the second pouch, the difference being selected from the group consisting of the thickness of the film, the degree of stretching of the film, the composition of the film, and mixtures thereof.

5. An as in to claim 3 wherein the first composition comprises an enzyme and the second composition comprises a bleach.

6. An article as in claim 3 wherein the first composition is released at least from about 60 seconds to about 5 minutes earlier than the second composition.

7. An article as in claim 3 wherein the first pouch has a soluble seal.

8. An article as in claim 1 wherein the first pouch has an elasticity recovery of from about 20% to about 100%.

9. An article as in claim 1 wherein the first composition is in solid form.

10. An article as in claim 1 whereby the first composition is liquid.

11. An article as in claim 1 whereby the first composition is a fabric cleaning composition, comprising at least one or more surfactants and a builder, chelant and/or enzyme and the second composition comprises a bleaching agent.

12. An article as in claim 1 whereby the first composition is a fabric cleaning composition comprising at least one or more surfactants, a builder, chelant and/or enzyme and the second composition comprises a non-cleaning, fabric care agent.

13. An article as in claim 1 whereby the first composition is a fabric care composition selected from the group consisting of softening agents, perfumes, anti-wrinkling agents or mixtures thereof.

14. An article as in claim 1 whereby the second composition comprises a nonionic surfactant and/or fabric softener, dye or opacifier and perfume.

15. An article as in claim 1 whereby one composition comprises a bleach catalyst and/or peroxygen bleach and the other composition comprises a peracid and/or a precursor thereof, or whereby one composition comprises a peroxygen bleach and/or peracid precursor and the other composition comprises a peracid.

16. Process for making the article of claim 1 comprising the steps of a) formation of the second pouch in open form, adding the second composition in said open second pouch and closing this to obtain the second pouch;

b) formation of the first pouch in open form, adding the second pouch and the first composition to the open first pouch and closing this first pouch to obtain the article.

* * * * *

UNITED STATES PATENT AND TRADEMARK OFFICE

CERTIFICATE OF CORRECTION

PATENT NO. : 6,727,215 B2 
DATED : April 27, 2004
INVENTOR(S) : Nigel Patrick Somerville Roberts et al.

It is certified that error appears in the above-identified patent and that said Letters Patent is hereby corrected as shown below:

Column 21,
Line 1, claim 5 should read -- An article as in Claim 3 wherein the first composition comprises an enzyme and the second composition comprises a bleach. --

Signed and Sealed this

Sixteenth Day of November, 2004

JON W. DUDAS
*Director of the United States Patent and Trademark Office*